US007507514B2

(12) United States Patent
Tanma et al.

(10) Patent No.: US 7,507,514 B2
(45) Date of Patent: Mar. 24, 2009

(54) TONER AND MANUFACTURING METHOD OF THE SAME

(75) Inventors: Tomoko Tanma, Hino (JP); Meizo Shirose, Hachioji (JP); Asao Matsushima, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 432 days.

(21) Appl. No.: 11/144,699

(22) Filed: Jun. 6, 2005

(65) Prior Publication Data

US 2005/0277043 A1 Dec. 15, 2005

(30) Foreign Application Priority Data

Jun. 9, 2004 (JP) ..... 2004-170861

(51) Int. Cl.
*G03G 9/087* (2006.01)

(52) U.S. Cl. ..... 430/109.31; 430/109.3; 430/110.1; 430/137.14; 430/123.54

(58) Field of Classification Search ..... 430/109.3, 430/137.14, 110.1, 123.54, 123.5, 109.31
See application file for complete search history.

(56) References Cited

U.S. PATENT DOCUMENTS 5,250,382 A * 10/1993 Shimojo et al. ..... 430/110.1

FOREIGN PATENT DOCUMENTS

JP 06-342225 A 12/1994
JP 2000-081730 A 3/2000
JP 2004-294838 * 10/2004

OTHER PUBLICATIONS

Japanese Patent Office machine-assisted translation of JP 2004-294838 (pub. Oct. 21, 2004).*
Japanese Office Action mailed Dec. 11, 2007, for corresponding Japanese Patent Application and English translation thereof.

* cited by examiner

*Primary Examiner*—Janis L Dote
(74) *Attorney, Agent, or Firm*—Finnegan, Henderson, Farabow, Garrett & Dunner, L.L.P.

(57) ABSTRACT

Toner containing binder resin constituted of plural types of copolymers comprising a vinyl type polymerizing monomer, wherein at least one of the copolymers comprising a vinyl type polymerizing monomer is one formed by utilizing a monomer provided with at least two polar groups.

12 Claims, 2 Drawing Sheets

TONER AND MANUFACTURING METHOD OF THE SAME

BACKGROUND

1. Technical Field

The present invention relates to toner, which is utilized in such as a printer, a copying machine and a facsimile, as well as toner images comprising which can be fixed at a low temperature, and a manufacturing method thereof.

2. Related Art

In the field of electrophotographic technologies of such as a copying machine and a printer, in accordance with development of digital technologies in recent years, image formation of high precision and high resolution, such as to accurately visualize dot images comprising as minute as a 1200 dpi (dpi represents a dot number per 1 inch or per 2.54 cm) level, has been required. To achieve such image formation of high precision and high resolution, minimization of a toner particle diameter has been also in progress, and, for example, remarkable is development of a minimization technique of the particle diameter by means of chemical toner represented by polymer toner.

By the way, when particle size minimization of toner proceeds, there is caused a tendency that a deviation in a charging property of toner particles is liable to be generated, and to make a uniform charging property of toner particles, for example, polyester resin is prepared from polycarboxylic acids or polyhydric alcohols which are provided with a polymerizing double bond in their structure, resulting in a toner technique containing said resin (refer to patent literature 1).

On the other hand, in view of energy saving, development of toner capable of being fixed at a low temperature has been made. For example, listed is a development of toner which exhibit a low temperature fixing ability by utilizing a vinyl type copolymer, provided with an acid group and a hydroxyl group, as binder resin, and taking measures such as adjusting a molecular weight distribution and a cross-linking structure formation or performing the resin design of a molecular chain structure corresponding to the molecular weight (refer to patent literature 2).

Further, there is listed development of toner to achieve low temperature fixing by utilizing a binder resin which is comprised of, urethane modified polyol resin utilizing polyisocyanate, and styrene type copolymer resin constituted of an acrylic acid ester type monomer or an methacrylic type monomer as a constituent unit (for example, refer to patent literature 3).

By the way, needs of energy saving for an image forming apparatus has been existing since olden times, however, recently, further higher become the needs of energy saving in an image forming apparatus.

This is considered to be because of significant change of a using style of copying machine and a printer, in particular, recently. For example, in an office, several sets of printers in each section have come to be utilized in connection to a LAN, and to decrease electricity consumption per an individual printer has come to be an important problem also in view of prevention of warming up of the earth in addition to achieving a comfortable working place and decreasing electricity cost.

In this way, toner capable of exhibiting stable fixing ability at a low temperature has been required, with respect to energy saving, operating environment of a user, as well as in view of global environment, however, it is necessary to set a low glass transition temperature of resin to enable stable fixing at low temperatures (for example, at a temperature lower than a boiling point of water).

However, when a glass transition temperature of resin is set lower, there is a tendency of toner particles to adhere or aggregate with each other resulting in difficulty of exhibiting a stable storage quality.

Further, in the case that binder resin or a releasing agent exhibiting a crystallizing property are contained in toner, decrease of glossiness and gloss unevenness of images are observed, which is estimated because of progress of crystallization even at a low temperature, resulting in an obstacle to form a printed image provided with beautiful finish.

Therefore, low temperature fixing toner has been required to be provided with not only a fixing ability but also storage stability not causing aggregation even in long term storage. Further, the formed toner image is required to have a fixing ability as well as beautiful finish without unevenness.

Further, recently, image technology of electrophotographic method is attracting attention in the field of small volume printing due to a merit of no troublesome to specifically prepare a plate, and has been applied for an image forming method of a print-on-demand mode which provides as many copies as required to reply a small scale order.

In such a printing application, since the types of paper utilized for image formation increase significantly compared to the application in the case of conventional copying machine or a printer, it is required to form toner images for every type of paper. However, it has been difficult to stably form toner images for every type of paper with present toner. Further, since the temperature at the time of fixing provides not a small effect on the fiber constituting paper, development of toner fixable at a lower temperature has been desired also in the case of being utilized in a small scale printing application.

[Patent literature 1] JP-A No. 2003-5441 (Hereinafter, JP-A refers to Japanese Patent Publication Open to Public Inspection.)

| | |
|---|---|
| [Patent literature 2] | JP-A No. 2003-57877 |
| [Patent literature 3] | JP-A No. 2004-20575 |

SUMMARY

An aspect of the present invention may be toner for developing an electrophotographic latent image including a binder resin which includes at least a first and second copolymers each formed by at least a vinyl type polymerizing monomer, wherein the first copolymer is formed by a monomer having at least two polar groups.

DETAIL DESCRIPTION OF THE EXEMPLARY EMBODIMENT

Figure 1:
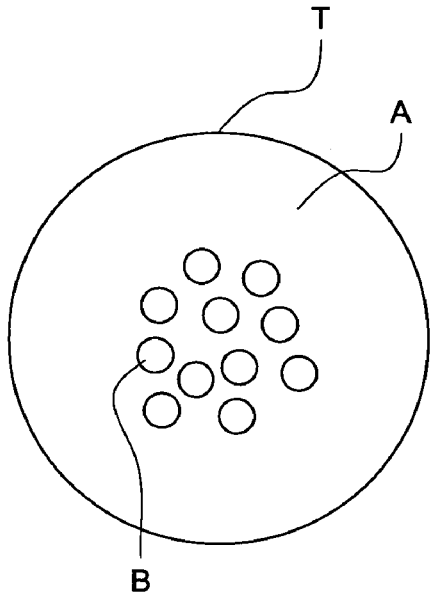
FIG. 1 is a schematic drawing of a toner particle employable to the invention.

The present invention has been made in view of the above problems, and an objective is to provide toner capable of dissolving the effect of an environmental load which is produced by using image forming apparatuses of electrophotographic method such as a copying machine, a printer and a facsimile. Specifically, it is an objective of this invention to provide toner capable of fixing toner images at a temperature lower than that having been achieved by conventional techniques as well as exhibiting a stable ability not to cause aggregation of toner particles with each other even in long term storage.

Further, another objective of this invention can be to provide toner, a fixed toner image of which has strength not easily to be peeled off even being fixed at a low temperature as well as which forms a print image of beautiful finish having uniform glossiness without unevenness.

Further, another objective of this invention can be to provide toner capable of stable image formation on paper types such as coated paper, heavy paper or thin paper on which image formation has been very difficult with conventional techniques. That is, the objective is to provide toner capable of image formation of a so-called print-on-demand mode, which performs printing of as many copies as required, without preparing a plate in the field of small scale printing by increasing the types of paper on which image formation is possible.

Objectives of this invention can be achieved by the following constitutions.

One embodiment of the constitution can be toner containing a binder resin comprising plural types of copolymers of a vinyl type polymerizing monomer, wherein at least one of the plural types of copolymers of a vinyl type polymerizing monomer is formed by utilizing a monomer with at least two polar groups.

It is preferable that the aforesaid binder resin is provided with a region having a low glass transition temperature.

It is also preferable that the region having a low glass transition temperature exists as an independent phase of 50-600 nm in the binder resin.

The aforesaid region preferably has a low glass transition temperature which is comprised of a vinyl type copolymer formed by utilizing the monomer having at least two polar groups.

The ratio of the vinyl type copolymer formed by utilizing a monomer with at least two polar groups is preferably 3-20 weight % based on the total binder resin weight.

The binder resin preferably has each peak molecular weight in ranges of 15000-25000 and 25000-35000, respectively.

The binder resin preferably contains a vinyl type copolymer comprising a dicarboxylic acid monomer as a copolymer component.

A second embodiment of the invention can be a toner manufacturing method in which toner is manufactured via process to form binder resin by aggregation of plural types of vinyl type copolymer particles, wherein at least one type of the vinyl type copolymer particles are those formed by utilizing a monomer with at least two polar groups, and binder resin is formed by aggregation of the other particles after performing aggregation of the particles formed by utilizing a monomer having at least two polar groups each other in the process to aggregate the vinyl type copolymer particles. The method may comprise aggregating particles of the first copolymer, and aggregating at least particles of the second copolymer after aggregating the particles of the first copolymer.

In the toner manufacturing method, the vinyl type copolymer particles, which are derived from a monomer with at least two polar groups, are preferably formed by utilizing a dicarboxylic acid monomer.

In the toner manufacturing method a glass transition temperature of the vinyl type copolymer particles, which are formed by utilizing a monomer with at least two polar groups, is preferably not higher than that of the other vinyl type copolymer particles.

In the toner manufacturing method, the vinyl type copolymer particles, which are formed by utilizing a monomer with at least two polar groups, and the other vinyl type copolymer particles are preferably provided with a difference of 0.3-1.2, between their solubility parameters.

It has been found that toner, in which binder resin is formed by aggregating plural types of vinyl type copolymer particles, enables fixing of toner images at as very low temperatures as conventional toner never achieved heretofore as well as exhibiting a stable storage stability without causing adhesion or aggregation of toner particles each other even in long term storage.

As a result, by utilizing toner according to this invention, significant energy saving of an image forming apparatus can be achieved, and for example, significant decrease of electricity consumption has been attempted even in the case that plural sets of copying machines and printers on a LAN connection are utilized in one section of a recent office, resulting in providing users with a comfortable operation environment even in places such as personally managed stores and ordinary homes where installation space is limited to some extent.

Further, the toner can be economically excellent toner which is comparatively low cost such as to perform installation investment to maintain toner capabilities during the storage or distribution process of a toner product because the toner exhibits a stable storage property.

Further, this invention can provide toner capable of forming a print image of beautiful finish with uniform glossiness without unevenness even when image formation is performed at a low fixing temperature.

Further, this invention enables to form a stable toner image also on paper types such as heavy paper, coated paper and thin paper on which image formation has been conventionally difficult by use of toner. That is, in this invention, selection range of paper types, which is utilizable for image formation, has been enlarged and printing which had been performed by means of a small scale printing has come to be possible by an electrophotographic method. As a result, preparation of printed materials of as many copies as required has come to be possible without troublesome of plate preparation, which made speed up and cost down of a book making work such as small volume printing.

In this manner, stable toner enabling image formation at low temperatures which has been impossible with conventional toner in an image formation technique is obtained.

The inventors of this invention have studied to develop toner which is capable of being fixed at low temperatures as well as fused rapidly with a small quantity of heat at the time of fixing and satisfies the ability of toner particles not adhering or aggregating with each other even in long term storage.

As a result, it has been found that toner described later, wherein binder resin to constitute toner is formed by associating resin particles provided with an amorphous (non-crystalline) structure such as structure shown in FIG. 1, exhibits the effects of this invention.

By manufacturing such toner, it has been confirmed that fixing at low temperatures becomes possible in a oil-less state and, for example, prepared can be toner an image comprising which is capable of being stably fixed at a temperature as low as not higher than the boiling point of water.

FIG. 1 is a schematic drawing of a toner particle of this invention.

In FIG. 1, toner particle T has a structure in which resin phase A includes resin phase B. Herein, toner particle T is characterized by that resin constituting resin phase B has a glass transition temperature of not higher than that of resin constituting resin phase A.

Toner particles including binder resin having such a structure can be formed via a process of associating amorphous (non-crystalline) resin particles, solubility parameters(SP value) of which differ by 0.3-1.2, in a manufacturing process of toner particles.

It has been found that toner comprising binder resin with a structure as shown in FIG. 1 can be prepared by aggregation utilizing resin particles formed by use of monomers at least one type of which is provided with at least two polar groups.

It is estimated that amorphous resin forms such a structure comprising resin phase A and resin phase B as shown in FIG. 1 by resin particles, which are formed utilizing a monomer having at least two polar groups, being coexisted and aggregated, because the difference between polar group concentrations of each resin particle may act so as to increase the probability of resin A having a slower aggregation rate being arranged at the outside of resin B.

That is, it is estimated that resin particles having at least two polar groups preferentially aggregate at the time of aggregation by the effect of a polar group and the residual resin particles aggregate after finishing said aggregation, resulting in formation of a structure in which resin phase A includes resin phase B.

Further, toner particles of a structure in which resin phase A includes resin phase B, the both phases being comprised of resin being incompatible with each other, has enabled the compatibility of fixing at low temperatures and a stable storage capability which has been impossible to be achieved by conventional techniques. That is, it is possible to adjust the fixing temperature to be lower by setting a glass transition temperature of resin constituting resin phase B to be lower, in addition to this, prepared can be a structure which hardly causes aggregation of toner particles each other by forming a structure in which resin phase B having a lower glass transition temperature is included in toner particles. And, it has been found that fixing is possible at a temperature, for example, approximately as low as the boiling point of water by preparing toner provided with a structure in which resin phase A includes resin phase B, the both phases comprising amorphous resin being incompatible with each other.

Further, toner according to this invention enables easy formation of toner images on coated paper or heavy paper on which image formation with toner has been difficult heretofore, resulting in significantly increasing the types of paper capable of image formation. The reason why increasing the types of paper has come to be possible is probably due to existence of resin formed by utilizing a monomer with at least two polar groups. That is, it is estimated that stable affinity with coated paper, which has been difficult to be obtained with conventional toner, can be also exhibited by increasing the affinity between toner particles and a recording sheet, due to inclusion of polar groups in resin.

As a result, according to toner of this invention, since toner images can be stably formed even on coated paper or heavy paper, image forming method by means of electrophotography become possible to be applied for image forming fields to which only printing can be applied heretofore. In particular, in the field of small volume printing in which a small scale printing is often ordered, document preparation in a print-on-demand mode, which performs a printing output of as many copies as required when necessary, has come to be possible without making a plate.

Toner will now be further detailed.

A toner particle of this invention have plural types of amorphous resin being incompatible with each other and provided with a structure comprising resin phase A and resin phase B as shown in FIG. 1. In particular, resin forming resin phase B is formed utilizing a vinyl type monomer with at least two polar groups, and prepared are toner particles provided with a structure comprising resin phase A, which is formed utilizing amorphous resin particles being incompatible with said resin phase B, and the resin phase B.

Herein, a monomer having at least two polar groups refers to a monomer with a functional group such as a carboxyl group and a hydroxyl group in the side chain of a vinyl type monomer, and specifically preferably a monomer providing a glass transition temperature of not higher than 50° C. when it forms resin phase B.

As binder resin, preferably utilized is an amorphous vinyl type copolymer. It is preferable with respect to promoting high speed image formation, that rapid operations of fusing of toner, adhesion to a recording sheet and solidification, at the time of fixing, become possible by utilizing resin provided with an amorphous structure as binder resin. In this invention, a vinyl type copolymer which forms an amorphous state can be obtained by preparing resin by use of a monomer described later.

A method to confirm that binder resin is one provided with an amorphous structure includes measurement methods such as an X ray diffraction method and a nuclear magnetic resonance spectroscopy.

Formed are toner particles with a structure comprising resin phase A and resin phase B as shown in FIG. 1 by utilizing plural types of amorphous resin, and it is preferably that resin constituting resin phase A and resin constituting resin phase B have properties of being incompatible with each other.

And, to constitute resin phases provided with a structure in which resin phase A includes resin phase B, resin particles are formed by utilizing the monomer with at least two polar groups at the time of forming resin phase B.

A monomer with at least two polar groups which forms resin constituting resin phase B will now be explained (hereinafter, also referred to as a polymerizing monomer).

A polar group as referred includes those provided with a dissociating property in a water-based solvent and forming salts. Specifically, listed are such as a carboxyl group, a sulfone group, an amino group and an ammonium group.

A monomer having at least two polar groups includes those containing a carboxyl group of such as itaconic acid and maleic acid.

Among these monomers, when they form resin of resin phase B, preferable are those giving a glass transition temperature of the resin of not higher than 50° C.

Further, it has been confirmed that formation of binder resin provided with a structure as shown in FIG. 1 is promoted when resin particles constituting resin phase B is prepared by using a monomer with at least two carboxyl groups such as itaconic acid and maleic acid in a molecule as the monomer with at least two polar groups.

It has been confirmed that toner particles utilizing resin particles prepared by using a monomer with at least two carboxyl groups such as itaconic acid and maleic acid among the monomers with polar groups are specifically preferable with respect to exhibiting the effects of this invention.

Further, polar groups in these monomers may be those having a form of an acid anhydride, acid chloride or a metal salt, in addition to those described above. These are preferably utilized in combination with 2-ethylhexyl acrylate or 2-ethylhexyl methacrylate for easier control of a SP value.

Further, as a monomer to form resin constituting resin phase B, such as styrene type monomers described later may be used together with the above-described monomer with at least two polar groups, to form copolymer resin. Specific examples of resin constituting resin phase B include, although this invention is not limited thereto, for example, a vinyl type copolymer formed by polymerizing 35-50 weight % of styrene, 30-50 weight % 2-ethylhexyl acrylate and 15-20 weight % of itaconic acid or maleic acid as monomers.

Next, a monomer forming resin which constitutes resin phase A will be explained.

A monomer forming resin which constitutes resin phase A includes, for example, a vinyl aromatic type monomer, a vinyl ester type monomer, a vinyl ether type monomer and a mono-olefin type monomer.

A vinyl aromatic type monomer includes styrene type derivatives such as styrene, o-methylstyrene, m-methylstyrene, p-methylstyrene, p-methoxystyrene, p-phenylstyrene, p-ethylstyrene, p-n-butyl styrene, p-tert-butyl styrene, p-n-hexyl styrene, p-n-octyl styrene, p-n-nonyl styrene, p-n-decylstyrene, p-n-decyl styrene, p-n-dodecylstyrene, 2,4 dimethyl styrene and 3,4-dichloro styrene.

A vinyl ester type monomer includes, for example, vinyl acetate, vinyl propionate and vinyl benzoate, and a vinyl ether type monomer includes such as vinylmethyl ether, vinylethyl ether, vinylisobutyl ether and vinylphenyl ether.

A mono-olefin type monomer includes such as ethylene, propylene, isobutylene, 1-butene, 1-pentene and 4-methyl-1-pentene, and a diolefin type monomer includes such as butadiene, isoprene and chloroprene.

Among these, a monomer to form resin which constitutes resin phase A is preferably a styrene type monomer or a monomer mixture of a styrene type monomer and another copolymerizing monomer, and the amount of a styrene type monomer is preferably not less than 50 weight % based on the total monomer amount.

A styrene type monomer includes such as styrene and p-methylstyrene.

Further, another copolymerizing monomer utilized together with a styrene type monomer includes acrylic acid ester type monomers such as ethyl acrylate, butyl acrylate and 2-ethylhexyl acrylate; methacrylic acid ester type monomers such as methyl methacrylate, ethyl methacrylate and butyl methacrylate; alkylvinyl ethers such as methylvinyl ether; vinyl ester type monomers such as vinyl acetate and vinyl butyrate; N-alkyl substituted acrylamides such as N-methylacrylamide and N-ethylacrylamide; nitrile type monomers such as acrylonitrile and methacrylonitrile; and poly-functional monomers such as divinylbenzene, ethyleneglycol (meth)acrylate and trimethylolpropane tri(meth)acrylate.

For example, those provided with at least two unsaturated bonds, such as divinylbenzene, divinylnaphthalene, divinyl ether, ethyleneglycol dimethacrylate and polyethyleneglycol dimethacrylate can be employed as a cross-linking monomer.

In this manner, since a polymer chain structure constituting binder resin is hardly provided with regularity or synchronization by utilizing a cross-linking monomer, an amorphous structure is easily obtained in addition that strength of resin can be increased without significantly increasing bonding energy between polymer chains. As a result, fixing at low temperatures is possible, in addition to this, for example, toner is not destroyed even repeated stirring in a development device resulting in improvement of toner durability.

Binder resin employable is comprised of plural types of vinyl type copolymers which are amorphous and have a relationship of being incompatible with each other. Further, binder resin employable is provided with at least one of the following characteristics. That is:

(1) The size of resin phase B is 50-600 nm.

(2) The glass transition temperature of resin which constitutes resin phase B is not higher than 50° C., and the glass transition temperature of resin which constitutes resin phase A is not higher than 70° C.

(3) The solubility parameter value (SP value) of resin which constitutes resin phase B is 9.5-10.0, and the solubility parameter value (SP value) of resin which constitutes resin phase A is 10.0-10.5.

(4) Binder resin is provided with peaks in molecular weight ranges of 15,000-25,000 and 25,000-35,000.

(5) The ratio of a lower molecular component (a molecular weight of not higher than 5,000) in binder resin is not more than 20 weight %.

In the following, the above characteristics will be specifically explained.

Binder resin utilized can be formed by aggregating amorphous vinyl type copolymer particles having a relationship being incompatible with each other.

Toner particles having a structure as shown in FIG. 1 can be obtained, specifically, by preparing vinyl type copolymer resin particles which constitutes resin phase A and vinyl type copolymer resin particles formed by utilizing a monomer with at least two polar groups, respectively, and via process to aggregate these resin particles.

It is possible to form toner particles having a structure as shown in FIG. 1 even when resin particles of different structures are coexisting in such a manner at the time of aggregating resin particles. It is not clear why binder resin can form a structure as shown in FIG. 1 in this manner, however, it is estimated that resin particles formed by utilizing a monomer with at least two polar groups make resin particles with at least two polar groups preferentially be aggregated each other, by the effect of the polar groups, followed by making the residual resin be aggregated, in the aggregation process.

It is confirmed that toner particles having a structure as shown in FIG. 1 can be obtained when the ratio of the aforesaid resin prepared by utilizing a monomer with at least two polar groups is set to be 3-20 weight % and preferably 5-15 weight %, and the size of resin phase B becomes 50-600 nm.

It can be confirmed that binder resin utilized in this invention has such a structure, by observing a toner particle slice, which has been dyed with such as an osmium compound, through a transparent type electron microscope (TEM).

A transparent type electronmicroscope (TEM) through which a structure of toner particles can be observed is preferably one of types in which observation is possible at an acceleration voltage of not more than 80 kV. Specifically, listed are such as "S-5000H" (manufactured by Hitachi Seisakusho) and "JEM-200FX" (manufactured by Nippon Denshi Co., Ltd.). In this invention, the size of resin phase B in a toner particle is calculated by projected area of at least 10 toner particles which have been photographed at a magnification of 10,000 times.

A photographing method utilizing an electron microscope is performed by as follows.

The observation and measurement of the cross section of toner particle are specifically performed by the following method. First, after sufficiently dispersing toner particles in ordinary temperature curable epoxy resin, a block including toner particles having been buried and cured is prepared. This block is cut out into a thin slice-formed sample with a microtome equipped with a diamond blade to prepare a sample for a transparent type electron microscope (TEM). Photographing of the cross sectional form of the toner particle is performed by utilizing this sample. Herein, the whole block or thinly sliced sample may be dyed by use of a dye solution of triruthenium tetroxide or a combination of triruthenium tetroxide and triosmium tetroxide.

The region of resin phase B in a toner particle is visually confirmed by said photo. Further, the size of resin phase B which is included in a toner particle is obtained by calculating an equivalent circle diameter. Concretely, the equivalent circle diameter of phase B can be calculated by an operation treatment of image data photographed by use of an image processing device "LUZEX F" (manufactured by Nireco Co., Ltd.).

Further, it is preferable that the glass transition temperature of resin which constitutes resin phase B is not higher than 50° C. while the glass transition temperature of resin which constitutes resin phase A is not higher than 70° C., and amorphous vinyl type copolymers which give a difference of the glass transition temperatures of not less than 20° C. are utilized; it has been confirmed that the problems of this invention can be solved by combining resin having such properties.

A vinyl type copolymer is preferably selected so as to make the glass transition temperature of resin which constitutes resin phase B included in toner particles of not higher than 50° C. and preferably 15-48° C., and further, a vinyl type copolymer is preferably selected so as to make the glass transition temperature of resin which constitutes resin phase A of not higher than 70° C. and preferably 40-60° C.

A glass transition temperature Tg is measured by use of an apparatus described later, and is defined as a temperature at the crossing point of, the extended line of the base line at lower than the glass transition temperature in DSC thermogram in a glass transition region, and the tangent line showing the maximum inclination between the rising toward the peak and the top of the peak.

Specific means to measure a glass transition temperature includes a differential thermal analyzer (DSC) such as DSC-7 manufactured by Perkin-Elmar Inc.

As heating and cooling conditions in the measurement, a sample is heated up to 10° C. at a rate of 10° C./min (the first heating process) after having been kept at 0° C. for 1 minute. Then, the sample is cooled down to 0° C. at a rate of 10° C./min (the first cooling process) after having been kept at 200° C. for 1 minute. Successively, the sample is heated up to 100° C. at a rate of 10° C./min (the second heating process) after having been kept at 0° C. for 1 minute. And the endothermic peak temperature of the second heating (the second heating) is determined to be a glass transition temperature Tg.

Further, it is convenient for resin design provided that a theoretical glass transition temperature is calculated in advance to grasp a grass transition temperature of each vinyl type copolymer which constitutes binder resin.

Herein, a theoretical glass transition temperature is obtained from glass transition temperatures of homopolymers, which are formed by each component constituting copolymer resin, by being multiplied each component weight ratio, that is, weighting averaged.

That is, a theoretical glass transition temperature Tg' can be calculated according to the following equation (1) when glass transition temperatures of component homopolymers which constitute copolymer resin are utilized.

$$1/Tg' = W_1/T_1 + W_2/T_2 + \ldots + W_n/T_n \qquad \text{Equation (1)}$$

(wherein, each of $W_1, W_2, \ldots W_n$ represents a weight ratio of each monomer utilized for manufacturing copolymer resin against the total monomers, and $T_1, T_2, \ldots T_n$ represent glass transition temperatures (absolute temperatures) of homopolymers formed by utilizing each monomer.) Herein, there may be generated some difference between the value of theoretical glass transition temperature obtained by calculation and the measurement result obtained by a differential thermal analyzer, however, it is not specifically a problem.

Further, it has been proved that the problem of this invention can be surely solved by designing an amorphous vinyl type copolymers so that a solubility parameter value (SP value) of resin which constitutes resin phase B and a solubility parameter (SP value) of resin which constitutes resin phase A are provided with a difference.

In this manner, with respect to binder resin which constitutes toner according to this invention, incompatibility between the resins is exhibited by providing some difference of a solubility parameter value (SP value) between utilized plural types of vinyl type copolymers.

Herein, a solubility parameter value (SP value) is a value representing the amount of aggregation energy and a solubility parameter value a of binder resin is calculated by following equation (2). When an evaporation energy and a mol volume each are Δei and Δvi, according to a method of "Polym. Eng. Sci., vol. 14, p. 147 (1974)" proposed by Feors.

$$\sigma = (\Sigma\Delta ei/\Sigma\Delta vi)^{1/2} \qquad \text{Equation (2)}$$

Further, a solubility parameter value of each vinyl type copolymer is calculated from a product of a solubility parameter value and a mol ratio of each component. For example, suppose that a copolymer resin is comprised of two types of monomers of X and Y, each monomer ratio is x/Mx (mol %) and y/My (mol %) when a weight component ratio of each monomer is x and y (weight %), a molecular weight is Mx and My and a solubility parameter value is SPx and Spy. Herein, when a mol ratio of a copolymer is C, C=x/Mx+y/My and a solubility parameter value Sp of this copolymer resin is represented by following equation (3) described below.

$$Sp = |(x \times SPx/Mx) + (y \times SPy/My)| \times 1/C \qquad \text{Equation (3)}$$

Herein, solubility parameter SPx and Spy of each monomer is calculated by equation (2) described above, and specific values described in the literatures of "Polymer Handbook" (Published by Willy Corp) the 4th edition may be utilized.

Herein, a solubility parameter value can be controlled by changing the component ratios of monomers which constitute a vinyl type copolymer, and for example, a copolymer, which is formed by utilizing styrene and methyl methacrylate, has been confirmed to have a tendency of lowering the solubility parameter value by decreasing the styrene composition ratio and increasing the methyl methacrylate composition ratio.

Further, as for the summary of a solubility parameter of polymer materials may be referred to the item of solubility parameters (http://polymer.nims.go.jp/guide/guide/p5110.html) described in data base, PolyInfo (http://polymer.nims.go.jp), provided by "Research Organization of Substances and Materials" of Independent Administration Corporation.

With respect to the molecular weight of binder resin which can be employed in toner of the invention, the molecular weight is provided with molecular weight peaks in a range of 15,000-25,000 and a range of 25,000-35,000 and preferably in a range of 20,000-25,000 and a range of 25,000-30,000, respectively. Binder resin which can constitute the toner is formed from plural types of vinyl type copolymers, and these resins do not have a large difference with respect to the molecular weight. Plural types of resin which constitutes binder resin are provided with a relationship of incompatibility and it is considered that not being provided with a large difference of a molecular weight is also an important factor to exhibit incompatibility.

On the other hand, although the molecular weights of plural types of resin are not provided with a significant difference, it has been found in this invention that toner images can be fixed at a temperature as low as a boiling point of water.

The above-described peak molecular weight can be measured by use of a gel permeation chromatograph employing tetrahydrofuran (THF) as a column solvent, and calculated from the count number of obtained GCP chromatogram utilizing a calibration line described later.

Specifically, 1 mg of a sample to be measured is added with 1 ml of THF, and the solution is stirred by use of a magnetic stirred at room temperature to be sufficiently dissolved. Next, the sample solution is injected into a GOP after having been filtered through a membrane filter having a pore size of 0.45-0.50 μm. As measurement conditions of GPO, the column is stabilized at 40°C., THF is added at a flow rate of 1 ml per minute and approximately 100 μl of a sample having a concentration of 1 mg/ml are injected for measurement. As a column, polystyrene gel columns available on the market are preferably utilized in combination. For example, listed are combinations of SHODEX GCP KF-8-01, 802, 803, 804, 805, 806 and 807, manufactured by Showa Denko K. K. and combinations of TSK gel G1001H, G2000H, G3000H, G4000H, G5000H, G6000H, G7000H and TSK guard column, manufactured by Tosoh Oorp.

As a detector, a diffractive index detector (IR detector) or a UV detector is preferably utilized. In measurement of the molecular weight of a sample, the molecular weight distribution is calculated by use of a calibration line formed by utilizing monodispersed polystyrene standard particles. Approximately 10 samples are preferably utilized as polystyrene to form a calibration line.

Further, when attention is given to the molecular weight distribution of binder resin which can constitute toner according to this invention, in binder resin utilized in this invention, for example, the ratio of a lower molecular weight component having a molecular weight of not more than 5,000 is not more than 20 weight % and preferably 10-19 weight % when the ratio of resin which can constitute resin phase B is 10 weight %, and it has been found that toner images can be stably formed at a low temperature, which could not be achieved by such conventional techniques as described before, even with a small ratio of a lower molecular weight component in the total resin. Herein, the molecular weight distribution can be measured by a GPC described before.

In this manner, in this invention, the ratio of a lower molecular weight component having a molecular weight of not more than 5,000 is low when the molecular distribution of binder resin is measured, and low temperature fixing ability is exhibited by utilizing the aforesaid resin constituting resin phase B and resin phase A which are not provided with a significant difference in their molecular weight; it was unexpected at all that problems of this invention have been solved by utilizing such resin. Herein, the ratio of a lower molecular weight component referred here may be that including the content of such as a releasing agent in toner in addition to resin component.

Further, toner according to this invention may be one containing 250-20,000 ppm of a polyvalent metal element.

Toner according to this invention may contain such metal elements as described below, for example, due to such reasons as utilization of a metal salt as a coagulant in a process aggregating resin particles from a dispersion of resin particles which have been prepared in a water-based medium, and primarily contains a divalent or trivalent metal salt.

The reason is such as that more preferably utilized is a divalent or trivalent metal salt than a mono-valent metal salt in an aggregation process due to the smaller critical aggregation concentration.

It is estimated that to contain a metal element in toner particles exhibits an effect to prevent excessive charge and to provide a uniform charging property on toner particles, as well as contributes to form a structure having a resin phase included in toner particles as shown in FIG. 1 by providing a selectivity of aggregation by the electrical function when binder resin aggregates.

In particular, toner according to this invention preferably contains metal elements (including metals and metal ions as a form) described above at 250-20,000 ppm and more preferably 800-5,000 ppm in toner, with respect to forming an excellent structure as shown in FIG. 1 as well as stabilizing and maintaining a charging property against environment.

Next metal elements contained in toner will be explained.

Monovalent metals include, for example, alkali metals such as sodium, potassium and lithium; divalent metals include, for example, alkali earth metals such as calcium and magnesium, manganese and copper; and trivalent metals include such as iron and aluminum. These metals are supplied as metal salts in a toner manufacturing process, and specific examples of the metal salts will be shown below.

Specific examples of monovalent metal salts include such as sodium chloride, potassium chloride and lithium chloride. Divalent metal salts include such as magnesium chloride, calcium chloride, calcium nitrate, zinc chloride, cupper sulfate, magnesium sulfate and manganese sulfate. Trivalent metal salts include such as aluminum chloride and iron chloride. These are suitably selected depending to the purpose.

The measurement of an amount of metals in toner is performed by measuring the strength of fluorescent rays emitted from metal species of metal salts by use of a fluorescent X ray analyzer, "SYSTEM 3270 Type"(manufactured by Rigaku Electric Industry CO., Ltd.). As a specific measurement method, a plural number of toners, the amount of metal salt content of which is known, are prepared, and each 5 g of toner being pelleted, and the relationship (calibration line) between the content ratio of a metal salt and a fluorescent X ray strength from a metal species of said metal salt is measured. Next, toner (a sample), the content ratio of which is to be measured, is similarly pelleted to measure the fluorescent X ray strength from a metal species of a metal salt, resulting in determining the content ratio, that is, "a metal content in toner"can be obtained.

Next, manufacturing method of toner according to this invention will be explained.

A manufacturing method of toner according to this invention is not specifically limited provided that toner is formed by preparing plural types of vinyl type copolymer resin particles and via process in which said resin particles are aggregated.

Specific manufacturing methods of toner include such as an emulsion association method, a suspension polymerization method, a dispersion polymerization method and a dissolution suspension method. In the following, a manufacturing method of toner by means of an emulsion association method, which is provided with a merit of easier control of the shape and size of toner particles, will be explained.

A manufacturing method of toner by an emulsion association method includes, for example, a method in which toner is manufactured by resin particles being salting out/fused in a water-based medium as disclosed in JP-A No. 2002-351142.

In this method, toner is manufactured in the following manner: resin particles are dispersed in a water-based medium by use of an emulsifier, followed by being salting out with addition of a coagulant of a concentration not less than the critical aggregation concentration simultaneous with growing the particle size while forming fused particles by being heating fused at a temperature not lower than a glass transition temperature of formed polymer itself, then particle growth is stopped by addition of a plenty of water when the aimed particle size is reached, and further the particle surface is smoothened to control the shape while being heated and stirred.

Further, a manufacturing method of toner according to this invention also includes a method called as an emulsion polymerization aggregation method described, for example, in JP-A Nos. 2001-305797 and 2002-214838. In this method, toner particles are manufactured by a micro-particle dispersion prepared by an emulsion polymerization being mixed and dispersed with a colorant dispersion and a releasing agent dispersion, which are in a state of a micro-dispersion form, followed by being heated to be aggregated.

In either of these manufacturing methods of toner, toner is manufactured via process in which resin particles prepared by an emulsion polymerization are aggregated in a water-based medium.

Herein, a water-based medium refers to a medium comprising 50-100 weight % of water and 0-50 weight % of a water-soluble organic solvent. A water-soluble organic solvent is exemplified by such as methanol, ethanol, isopropanol, butanol, acetone, methyl ethyl ketone and tetrahydrofuran, and preferred are alcohol type organic solvents which do not dissolve obtained resin.

The ratio (weight %) of a polymerizing monomer to a water-based medium is preferably in a range of 1/10-1/2.

Toner according to this invention can be constituted of a structure comprising resin phase A, and resin phase B which is included in resin phase A. Utilized are plural types of vinyl type copolymers incompatible with each other which constitute binder resin, and obtained can be toner particles capable of being fixed at a significantly low temperature and having such a structure a shown in FIG. 1, by selecting resin formed by utilizing a monomer provided with at least two polar groups at least as one type among these resins.

That is, each resin particles do not randomly aggregate with each other but particles of resin, which is formed by utilizing a monomer provided with at least two polar groups, preferentially aggregate each other even plural types of resin particles are coexisting in a process to aggregate resin particles, and then residual other resin particles aggregate to form toner particles. In addition to this, there is a tendency that a colorant component and a releasing agent component are not contained in resin phase B comprising resin which is formed from a monomer provided with at least two polar groups. With respect to this, it has been confirmed that a releasing agent is not contained in resin phase B also in the aforesaid manufacturing method, disclosed in JP-A Nos. 2001-305797 and 2002-214838, in which resin particles are aggregated in the presence of a colorant and a releasing agent.

Such toner particles prepared via an aggregation process of resin particles in a water-base medium are washed, dehydrated and dried, via a solid-liquid separation, washing process and a drying process.

That is, in a solid-liquid separation and washing process, toner cake is prepared by solid-liquid separation from the dispersion phase of toner particles prepared by the above process and a washing treatment is provided to eliminate adhered substances such as a surfactant and a salting out agent from obtained toner cake. A solid-liquid separation and drying method includes such as a centrifugal separation method, a reduced pressure filtration method using such as a Buchner funnel, and a filtration method using such as a filter press, however, is not specifically limited.

In a drying process, toner particles, which have been subjected to a washing treatment, are drying treated. A dryer utilized in a drying process includes a spray dryer, a vacuum freezing dryer, a reduced pressure dryer, a standing shelf dryer, a transferring shelf dryer, a fluid layer dryer, a rotational dryer and a stirring dryer, however, is not specifically limited.

The water content in toner particles having been drying processed is preferably not more than 5 weight % and more preferably not more than 2 weight %.

Next, the elements such as a releasing agent, a colorant and a surfactant utilized in manufacturing of toner will be explained. Herein, a polymerizing monomer is as described above and the explanation is omitted here.

A releasing agent is not specifically limited and those commonly known can be utilized. Specifically, listed are low molecular weight polyolefin wax such as low molecular weight polypropylene (number average molecular weight=1500-9000) and low molecular weight polyethylene; paraffin wax; Fischertropush wax and ester wax. Preferably utilized is ester wax represented by the following general formula.

$$R_1—(OCO—R_2)_n \qquad \text{General formula}$$

wherein, n represents an integer of 1-4, preferably 1-3 and more preferably 1-2.

$R_1$ and $R_2$ represent hydrocarbon groups which may be provided with a substituent.

$R_1$: a carbon number of 1-40, preferably 1-30 and further preferably 16-26

$R_2$: a carbon number of 1-40, preferably 14-30 and further preferably 16-26

In the following, specific examples of ester compounds represented by the above general formula, and preferable among them are such as behenyl behenate, stearyl stearate, behenyl stearate and stearyl behenate. Other than these, such as paraffin wax and higher alcohol which are modified with a polar group are preferably utilized.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

-continued

8)

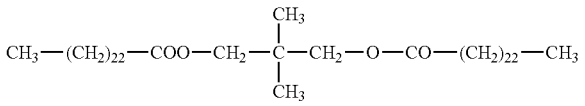

9)

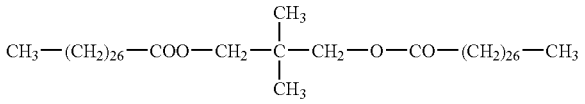

10)

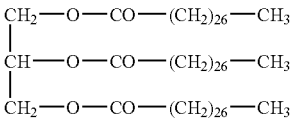

11)

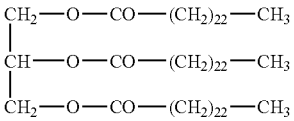

12)

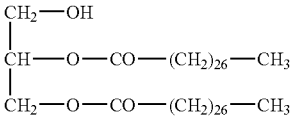

13)

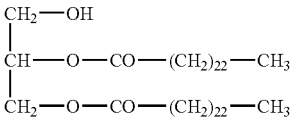

14)

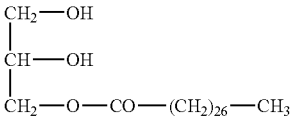

15)

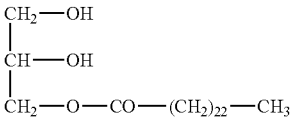

16)

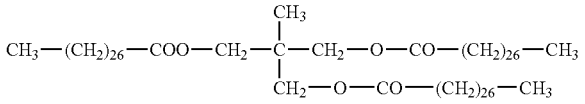

17)

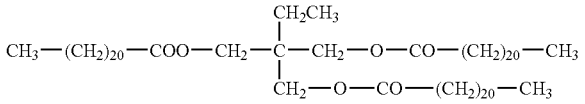

18)

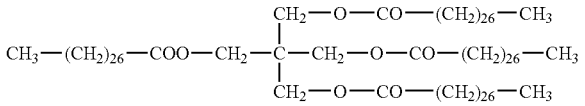

19)

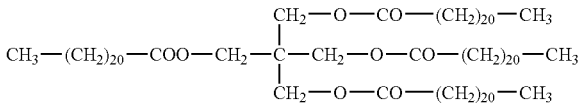

-continued

20)

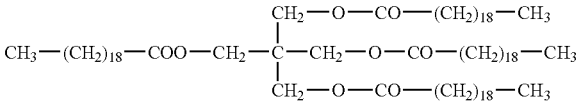

21)

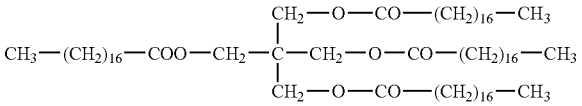

22)

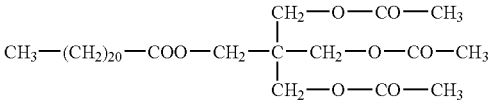

The content of a releasing agent in toner particles is preferably in a range of 1-30 weight %, more preferably 7-27 weight % and furthermore preferably 10-25 weight %, based on the total amount of toner particles.

As a colorant, those commonly known as either an organic pigment or a dye can be utilized, and specific organic pigments and dyes are shown below.

Magenta or red pigments include, for example, C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red. 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178 and C. I. Pigment Red 222.

Orange or yellow pigments include, for example, C. I. Pigment Orange 31, C. I. Pigment Orange 43, C. I. Pigment Yellow 12, C. I. Pigment Yellow 13, Pigment Yellow 14, C. I. Pigment Yellow 15, C. I. Pigment Yellow 17, C. I. Pigment Yellow 93, C. I. Pigment Yellow 94, C. I. Pigment Yellow 138, C. I. Pigment Yellow 180, C. I. Pigment Yellow 185, C. I. Pigment Yellow 155 and C. I. Pigment Yellow 156.

Green or cyan pigments include, for example, C. I. Pigment Blue 15, C. I. Pigment Blue 15:2, C. I. Pigment Blue 15:3, C. I. Pigment Blue 16, C. I. Pigment Blue 60 and C. I. Pigment Green 7.

Further, as dyes, for example, utilized can be C. I. Solvent Red 1, C. I. Solvent Red 49, C. I. Solvent Red 52, C. I. Solvent Red 58, C. I. Solvent Red 63, C. I. Solvent Red 111, C. I. Solvent Red 122, C. I. Solvent Yellow 19, C. I. Solvent Yellow 44, C. I. Solvent Yellow 77, C. I. Solvent Yellow 79, C. I. Solvent Yellow 81, C. I. Solvent Yellow 82, C. I. Solvent Yellow 93, C. I. Solvent Yellow 98, C. I. Solvent Yellow 103, C. I. Solvent Yellow 104, C. I. Solvent Yellow 112, C. I. Solvent Yellow 162, C. I. Solvent Blue 25, C. I. Solvent Blue 36, C. I. Solvent Blue 60, C. I. Solvent Blue 70, C. I. Solvent Blue 93 and C. I. Solvent Blue 95, in addition to mixtures thereof.

These organic pigments and dyes can be appropriately utilized alone or in combination of plural types by selection.

The content ratio of colorant in toner particles is preferably 2-20 weight % and more preferably 3-15 weight %, based on the total amount of toner particles.

In a manufacturing process of toner, oil droplet dispersion in a water-based medium is preferably performed by use of a surfactant. A surfactant utilizable in this case is not specifically limited and includes the following ionic surfactants as examples of preferable compounds.

Ionic surfactants include, for example, sulfonates (such as sodium dodecylbenzene sulfonate, sodium arylalkylpolyether sulfonate, sodium 3,3-disulfondiphenylurea-4,4-diazo-bis-amino-8-naphthol-6-sulfonate, sodium ortho-carboxybenzene-azo-dimethylaniline-2,2,5,5-tetramethyltriphenylmethane-4,4-diazo-bis-β-naphthol-6-sulfonate), sulfuric esters (such as sodium dodecyl sulfate, sodium tetradecyl sulfate, sodium pentadecyl sulfate and sodium octyl sulfate) and fatty acid salts (such as sodium oleate, sodium laurate, sodium capriate, sodium caprylate, sodium caproate, potassium stearate and calcium oleate).

Further, it is preferable to utilize surfactants of following general formulas (1) and (2) in combination.

$R_1(OR_2)_nOSO_3M$ General formula (1)

$R_1(OR_2)_nSO_3M$ General formula (2)

In general formulas (1) and (2), $R_1$ represents an alkyl group or an arylalkyl group having a carbon number of 6-22, preferably an alkyl group or an arylalkyl group having a carbon number of 8-20 and more preferably an alkyl group or an arylalkyl group having a carbon number of 9-16.

In general formulas (1) and (2), $R_2$ represents an alkylene group having a carbon number of 2-6 and preferably an alkylene group having a carbon number of 2-3. Alkylene groups having a carbon number of 2-6 represented by $R_2$ includes such as an ethylene group, a trimethylene group, a tetramethylene group, a propylene group and an ethylethylene group.

In general formulas (1) and (2), n represents an integer of 1-11, preferably 2-10, more preferably 2-5 and most preferably 2-3.

In general formulas (1) and (2), monovalent metals represented by M include sodium and lithium. Utilized preferably among them is sodium.

In the following, shown are specific examples of surfactants represented by general formulas (1) and (2), however, this invention is not limited thereto.

$C_{10}H_{21}(OCH_2CH_2)_2OSO_3Na$ Compound (101):

$C_{10}H_{21}(OCH_2CH_2)_3OSO_3Na$ Compound (102):

$C_{10}H_{21}(OCH_2CH_2)_2SO_3Na$ Compound (103):

$C_{10}H_{21}(OCH_2CH_2)_3SO_3Na$ Compound (104):

$C_8H_{17}(OCH_2CH(CH_3))_2OSO_3Na$ Compound (105):

$C_{18}H_{37}(OCH_2CH_2)_2OSO_3Na$ Compound (106):

The manufacturing process of toner according to this invention includes a process in which resin particles are aggregated by use of a coagulant from a dispersion of resin particles which has been prepared in a water-base medium, and a metal salt is preferably utilized as a coagulant. As specific coagulants, it is preferable to utilize divalent or trivalent metal salts as a coagulant, and divalent or trivalent metal salts are more preferable than monovalent metal salts due to the smaller critical aggregation concentration (aggregation value or aggregation point).

A critical aggregation concentration referred in this invention is an index with respect to stability of a dispersed phase in a water-based dispersion, and indicates an addition concentration of a coagulant when aggregation occurs with addition of a coagulant. This critical aggregation concentration varies significantly depending on latex and a dispersant themselves. For example, it is described in such as Polymer Chemistry 17, 601 (1960) by Seizo Okamura et al, and the value can be known according to these descriptions.

Further, as another method, it is possible that a desired salt is added into the objective particle dispersion with changing the concentration to measure the ζ potential of said dispersion, and the salt concentration of the point at which ζ potential starts to change is set to be a critical aggregation concentration.

A polymerization initiator is not specifically limited provided that it is a generally utilized oil-soluble polymerization catalyst which is soluble in the above polymerizing monomer, and for example, utilized can be peroxide type catalysts such as benzoyl peroxide, lauroyl peroxide and t-butyl peroxyoctate, and azo type catalysts such as azobisisobutyronitrile and azobisisovaleronitrile.

The primary suspension is prepared after these polymerizing initiators are dissolved in the above polymerizing monomer and the resulting solution is added in a water-based medium containing inorganic particles and surfactant or a dispersion stabilizing aid which is appropriately added.

As inorganic particles which function as a dispersion stabilizer, colloidal silica, aluminum oxide, zirconium oxide, zinc antimonate, titanium oxide and mixtures thereof, provided with a volume average primary particle diameter of 6-32 nm and preferably 7-17 nm, are preferably utilized.

The mean value of circularity of toner is preferably 0.951-0.988.

To control the toner shape into the above range, a suitable process finishing timing may be determined while monitoring characteristics of toner particles the shape of which is under control in such as an association or fusion process.

Monitoring means to arrange a measurement device inline and to control the process conditions based on the measurement result. That is, for example with respect to polymerization method toner which is formed by association or fusion of resin particles in a water-based medium, measurement of such as a shape is arranged inline, to measure the shape and particle size while performing successive sampling in such as a fusion process and the reaction is stopped when a desired shape is obtained.

Monitoring methods are not specifically limited, and a flow type particle image analyzer "FPIA-2000" (manufactured by Toa Medical Electronics Co. Ltd.) can be utilized. This apparatus is preferred because monitoring of a shape is possible by performing real time image processing while a sample liquid is being passed through said apparatus. That is, the sample liquid is monitored always, by use of such as a pump from the reaction point, to measure such as a shape, and the reaction is stopped when a desired shape is obtained.

The median diameter D50 based on volume distribution of toner is preferably 2-7 μm and more preferably 2.5-6.5 μm. It can be controlled by the concentration of a coagulant and the addition amount of an organic solvent, in addition to the fusing time as well as the composition of polymer itself, in the case of toner particles are formed by polymerization method.

By setting the D50 based on volume distribution to 2-7 μm, toner micro-particles, having a large adhesion strength, which may fly to adhere on a heating member to cause offset, are decreased as well as the transfer ratio is increased to improve image quality resulting in improved image quality of such as fine lines and dots.

A D50 based on volume distribution of toner is measured by "COULTER MUTISIZER" (manufactured by Beckman Coulter Corp.) in connection with data processing computer system (manufactured by Beckman Coulter Corp.). To measure the D50, 0.02 g of toner is mixed with 20 ml of a solution having a surfactant (the solution can be employed a neutral detergent ten times diluted by pure water for purpose of dispersing toner). Then, dispersing by ultrasonic is taken place for 1 minute to prepare a toner dispersion. The toner dispersion is injected into a beaker with ISOTONII ((manufactured by Beckman Coulter Corp.) in a sample stand until the concentration at measurement reaches 5 to 10% by a pipette. The measurement will be started by setting number of counting as 250 in the apparatus. The aperture employed in above-described Coulter Multisizer was 50 μm.

As toner of this invention, utilized can be toner prepared above as it is, however, it is preferable to be added with external additives to improve the fluidity and a cleaning property. These external additives are not specifically limited and utilized can be various inorganic micro-particles, organic micro-particles and sliding agents.

Inorganic micro-particles utilizable as an external additive include those conventionally well known. Specifically, such as silica micro-particles, titanium oxide micro-particles and alumina micro-particles are preferably utilized. These inorganic micro-particles are preferably hydrophobic.

Specific examples of silica micro-particles include such as R-805, R-976, R-974, R-972, R-812 and R-809 which are available from Nippon Aerosil Co., Ltd.; HVK-2150 and H-200 which are manufactured by Heochist Corp.; TS-720, TS-530, TS-610, H-5 and MS-5 which are available from Cabbot Corp. and spherical monodispersion silica.

Specific example of titanium oxide micro-particles include, for example, T-805 and T-604 which are available from Nippon Aerosil Co., Ltd.; MT-100S, MT-100B, MT-500BS, MT-600, MT-600SS and JA-1 which are available from Teika Co., Ltd.

Specific example of titanium oxide micro-particles include such as TA-300SI, TA-500, TAF-130, TAF-510 and TAF-510T which are available from Fuji Titanium Co., Ltd.; IT-S, IT-OA, IT-OB and IT-OC which are available from Idemitsu Kosan Co., Ltd.; and lutil type titanium oxide.

Specific examples of alumina micro-particles include, for example, RFY-C and C-604 which are manufactured by Nippon Aerosil Co., Ltd. and available on the market; and such as TTO-55 which is manufactured by Ishihara Sangyo Kaisha, Ltd. and available on the market.

Organic micro-particles utilizable as an external additive include spherical micro-particles having a number average primary particle diameter of approximately 10-2000 nm. Constituent materials of such organic micro-particles include such as polystyrene, polymethylmethacrylate and a styrene-methylmethacrylate copolymer.

Sliding agents utilized as an external additive, include metal salts of higher fatty acids. Specific examples of such metal salts of higher fatty acids include metal stearates such as zinc stearate, aluminum stearate, copper stearate, magnesium stearate and calcium stearate; metal oleates such as zinc oleate, manganese oleate, iron oleate, copper oleate and magnesium oleate; metal palmitates such as zinc palmitate, copper palmitate, magnesium palmitate and calcium palmitate; metal linolates such as zinc linolate and calcium linolate; and metal recinolates such as zinc recinolate and calcium recinolate.

The addition amount of an external additive is preferably 0.1-5.0 weight % based on toner particles.

An apparatus for addition mixing of an external additive into toner particles includes various mixers commonly known such as a turbular mixer, a "HENSCHEL MIXER"(manufactured by Mitsui-Miike Chemical Industry Co., Ltd.), a nauter mixer and V type mixer.

Toner of this invention can be utilized for a one-component developer or a two-component developer. In the case of utilization as a one-component developer, listed are a non-magnetic one-component developer or a magnetic one-component developer containing magnetic particles of approximately 0.1-0.5 μm in toner, and either thereof can be utilized.

However, toner of this invention is preferably utilized as a two-component developer by mixing with magnetic particles. As a carrier utilized as magnetic particles, utilized can be materials conventionally known such as metals of iron, ferrite and magnetite and alloys of these metals and such as aluminum and lead. The above-described magnetic particles are preferably provided with a volume average particle diameter of 15-100 μm and more preferably 25-80 μm.

Measurement of the volume average particle diameter of carrier can be typically performed by use of a laser diffraction type particle size analyzer "HEROS" (manufactured by Sympatec Co., Ltd.) which is equipped with a wet type homogenizer.

A carrier is preferably one constituted of magnetic particles being further covered with resin or a resin dispersion type carrier in which magnetic particles are dispersed in resin. A resin composition for coating is not specifically limited, however, for example, utilized are such as olefin type resin, styrene type resin, styrene-acryl type resin, silicone type resin, ester type resin or fluorine-containing polymer type resin. Further, resin to constitute a resin dispersion type carrier is not specifically limited and those commonly known can be utilized. For example, such as styrene-acryl type resin, polyester resin, fluorine type resin and phenol resin can be utilized.

Next, an image forming apparatus utilized in an image forming method which employs toner of this invention will be explained.

Figure 2:
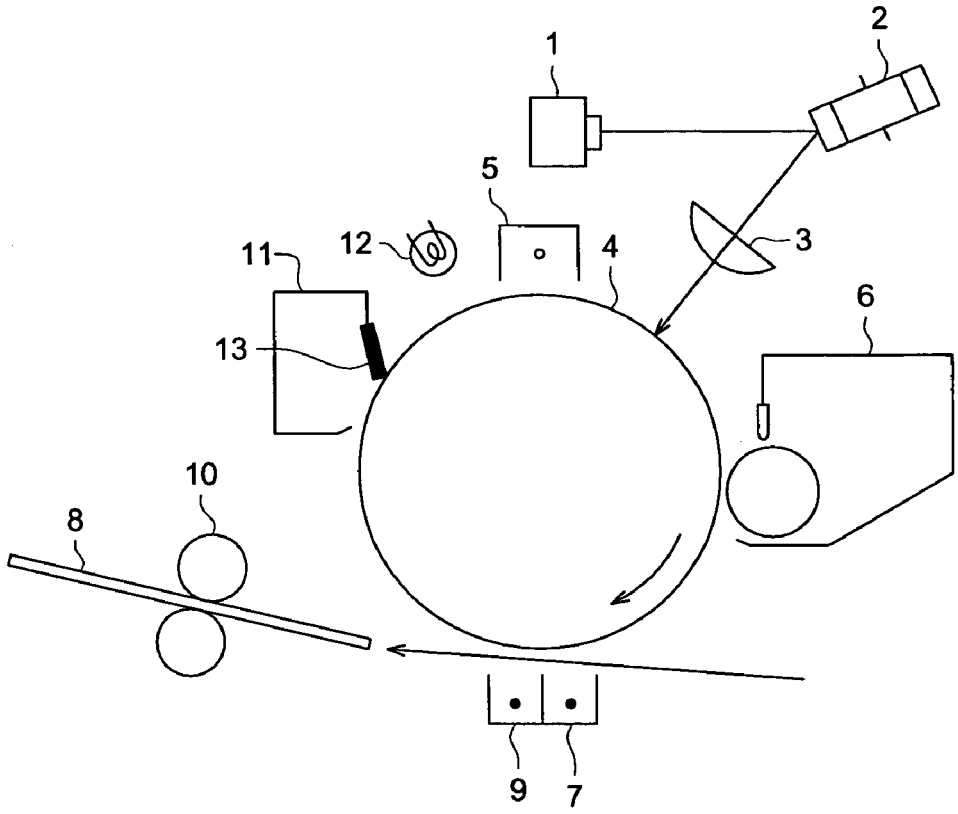
FIG. 2 is a cross-sectional constitutional view of an example of an image forming apparatus in which toner of this invention is utilized.

FIG. 2 is a cross-sectional constitution drawing to show an example of an image forming apparatus in which toner according to this invention is preferably utilized.

In FIG. 2, 4 is a photoreceptor drum comprising a charging material, and is prepared by forming an organic photoconductor (OPC) on an outer circumference of an aluminum drum substrate and rotates in the arrow head direction at a predetermined speed.

In FIG. 2, exposure light is emitted from semiconductor laser light source 1 based on the information having been read out by an original reading device which is not shown in the drawing. This is divided along the direction perpendicular to the paper surface of FIG. 1 by polygon mirror 2 and irradiated on a photoreceptor to make an electrostatic latent image via fθ lens 3 which corrects image distortions. Photoreceptor drum 4 has been uniformly charged in advance by charger 5 and starts clock-wise rotation synchronous with the timing of image exposure.

The electrostatic latent image on a photoreceptor is developed by developing device 6, and the formed developed image is transferred onto transfer paper (recording sheet) 8, which is synchronously transported, by the function of transfer device 7. Further, photoreceptor drum 4 and transfer paper 8 are separated from each other by separator (separator electrode) 9, and the developed image is transferring held on transfer paper 8 to be lead to fixing device 10.

Such as non-transferred toner remaining on the photoreceptor surface is cleaned by cleaning device 11 of a cleaning blade method, followed by the residual charge being removed by pre-charge exposure light (PCL) 12, and the photoreceptor is uniformly charged again by charger 5 for next image formation.

Nest, a recording sheet is typically plain paper, however, is not specifically limited provided that an unfixed image after development is transferable and such as PET base for an OHP application is naturally included.

Further, cleaning blade 13 utilizes a rubber elastomer having a thickness of approximately 1-30 mm and urethane rubber is most preferably utilized as a material. Heat is liable to be transferred since the cleaning blade is utilized being press contacted with a photoreceptor, and in this invention the cleaning blade is preferably provided with a removing mechanism to be separated from a photoreceptor while image formation is not performed.

This invention can be preferably applied to an image forming apparatus by means of an electrophotographic method, and, particularly, an apparatus in which an electrostatic latent image is formed on a photoreceptor by a modulated beam which is modulated according to a digital image data.

In recent years, in the field of electrophotography, in which an electrostatic latent image is formed on a photoreceptor and said latent image is developed to obtain a visible image, research and development of an image forming method employing an digital method, in which such as improvement of an image quality, conversion and editing are easy as well as image formation of a high quality is possible, has been actively undertaken.

A scanning optical system, which performs optical modulation according to a digital image signal from a computer or a original copy employed by the image forming method and apparatus, includes an apparatus, in which an acoustic optical modulator is combined with a laser optical system and optical modulation is performed by said acoustic optical modulator, and an apparatus, in which a semiconductor laser is employed and the laser strength is directly modulated, and an image comprising dots is formed by spot exposure from these scanning optical systems on a photoreceptor which has been uniformly charged.

A beam irradiated from the optical system described above shows a luminance distribution of a circular or elliptic form similar to a normal distribution having a widened foot in right and left direction, and, for example, in the case of a laser beam, is generally a minute circular or elliptic form having a diameter as narrow as 20-100 μm, as either or both of the main scan direction and/or sub scan direction on a photoreceptor.

Toner of this invention preferably applied to an image forming method including a process in which an image support on which a toner image is formed is passed through between a heat roller and a pressure roller to be fixed.

Figure 3:
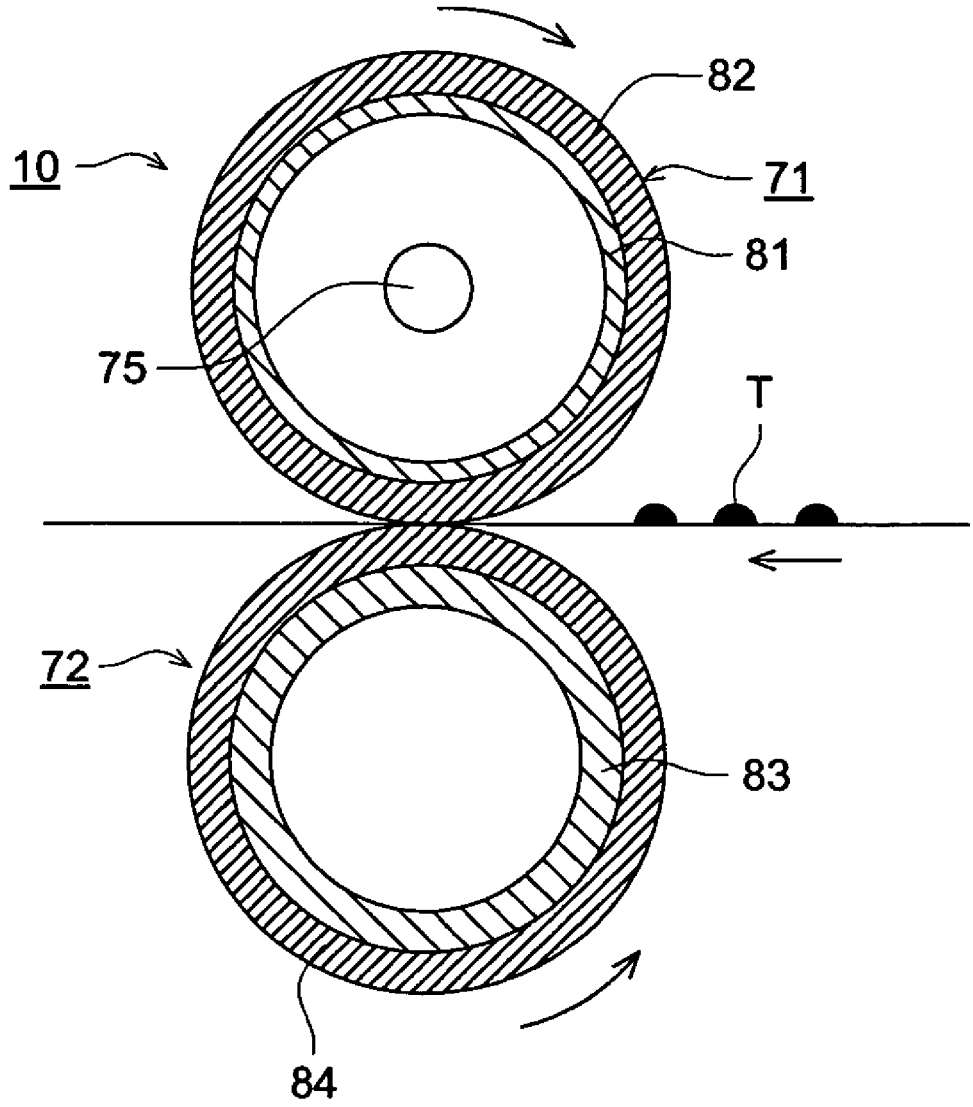
FIG. 3 is a cross-sectional view of an example of a fixing apparatus which is utilized for image formation employing toner according to this invention.

FIG. 3 is a cross sectional drawing to show an example of a fixing apparatus utilized in image formation employing toner according to this invention.

Fixing apparatus 10 shown in FIG. 3 is equipped with heat roller 71 and pressure roller 72 which is press contacted therewith. Herein, in FIG. 3, T is a toner image formed on transfer paper (a recording sheet).

A heat roller 71 is constituted of core metal 81 the surface of which is covered with covering layer 82 comprising fluorine resin or an elastic material, and includes heating member 75 comprising a line heater.

Core metal 81 is constituted of a metal and has an inner diameter of 10-70 mm. A metal to constitute core metal 81 is not specifically limited, however, includes metals such as iron, aluminum and copper or alloys thereof.

The thickness of core metal 81 is set to be 0.1-15 mm, and is determined in consideration of the balance between requirement of energy saving (making a thinner thickness) and strength. For example the thickness has to be 0.8 mm to maintain same strength as a core metal comprising iron of 0.57 mm thick.

As fluorine resin which constitute the surface of covering layer 82, exemplified are such as PTFE (polytetrafluoroethylene) and PFA (a tetrafluoroethylene-perfluoroalkylvinylether copolymer).

The thickness of covering layer 82 comprising fluorine resin is 10-500 μm and preferably 20-400 μm.

When the thickness of covering layer 82 comprising fluorine resin is less than 10 μm, the function of a covering layer is not sufficiently exhibited resulting in being unable to maintain the durability as a fixing apparatus. On the other hand, there is a problem that the surface of a core metal of over 500 μm thick is liable to generate cracks by paper dust and such as toner may adhere to said crack portion to cause image contamination.

Further, as an elastic material constituting covering layer 82, preferably utilized are silicone rubber and silicone sponge rubber such as LTV, RTV and HTV, which have excellent heat resistance.

The Asker C hardness of an elastic material constituting covering layer 82 is less than 80° and preferably less than 60°.

Further, the thickness of covering layer 82 comprising an elastic material is 0.1-30 mm and preferably 0.1-20 mm.

In the case that the Asker C hardness of an elastic material constituting covering layer 82 is over 80° and the thickness of said covering layer 82 is less than 0.1 mm, a nip of fixing cannot be increased resulting in no exhibition of an effect of soft fixing (for example, an improvement effect of color reproduction due to toner layer at the smoothened interface).

As heating member 75, a halogen heater is preferably utilized.

Pressure roller 72 is constituted of core metal 83, on which covering layer 84 comprising an elastic material is formed. An elastic material constituting covering layer 84 is not specifically limited and includes various soft rubber and sponge rubber such as urethane rubber and silicone rubber, and preferably utilized are silicone rubber and silicone sponge rubber which are exemplified to constitute covering layer 84.

The Asker C hardness of an elastic material constituting covering layer 84 is less than 80°, preferably less than 70° and more preferably less than 60°.

Further, the thickness of covering layer 84 is 0.1-30 mm and preferably 0.1-20 mm.

In the case that the Asker C hardness of an elastic material constituting covering layer 84 is over 80° and the thickness of said covering layer 84 is less than 0.1 mm, a nip of fixing cannot be increased resulting in no exhibition of an effect of soft fixing.

The material to constitute core metal 83 is not specifically limited and includes metals such as aluminum, iron and copper or alloys thereof.

A press contacting weight (a total weight) between heat roller 10 and pressure roller 72 is generally 40-350 N, preferably 50-300 N and more preferably 50-250 N. This press contacting weight is defined in consideration of the strength (thickness of core metal 81) of heat roller 10, and, for example, it is preferably set to be not more than 250 N in the case of a heat roller provided with a core metal comprising 0.3 mm thick iron.

Further, with respect to off set resistance and a fixing ability, the nip width is preferably 4-10 mm and said nip surface pressure is preferably $0.6\times10^5$-$1.5\times10^5$ Pa.

As an example of the fixing condition by use of a fixing apparatus shown in FIG. 3, a fixing temperature (a surface temperature of heat roller 10) is set to be 70-210° C. and a fixing line speed is set to be 80-640 mm/sec.

EXAMPLES

In the following, this invention will be specifically explained referring to examples, however, embodiments of this invention are not limited thereto.

<Preparation of Toner>

<Preparation of Toner 1>

(Preparation of Resin Particles (A1) Dispersion)

A surfactant solution, in which 7.08 g of an anionic surfactant had been dissolved in 2760 g of ion exchanged water, was charged into a separable flask equipped with a stirrer, a thermometer, a condenser and a nitrogen introducing device, and the inside temperature was raised up to 80° C. while being stirred at 230 rpm under nitrogen gas flow.

| | |
|---|---|
| On the other hand, | |
| Example compound (20) | 72.0 g |
| Styrene | 115.1 g |
| n-Butylacrylate | 42.0 g |
| Methacrylic acid | 10.9 g |

were mixed and dissolved by being heated at 80° C. to prepare a monomer solution. The above-described two heated solutions were mixed and dispersed, by use of a mechanical homogenizer having a circulating path, resulting in preparation of emulsion particles having a uniform dispersion particle diameter.

Next, a solution, in which 0.84 g of a polymerization initiator (potassium persulfate: KPS) is dissolved in 200 g of ion exchanged water, was added to the system, which was heated and stirred for 3 hours resulting in preparation of resin particles. Successively, a solution, in which 8.00 g of a polymerization initiator (KPS) and 10.0 g of 2-chloroethanol as a water-soluble chain transferring agent were dissolved in 240 g of ion exchanged water, was further added to the system, and, after 15 minute, a mixed solution (the second monomer solution) of 383.6 of styrene, 140.0 g of n-butylacrylate and 36.4 g of methacrylic acid was added drop-wise to the system in 120 minutes. After finishing the titration, the system was heated and stirred for 60 minutes followed by being cooled down to 40° C. to prepare a resin particle dispersion.

This resin particle dispersion was designated as "resin particle (A1) dispersion".

(Preparation of Resin Particles (A2) Dispersion)

"Resin particle (A2) dispersion" was prepared in a similar manner to preparation of the "resin particle (A1) dispersion", except that the addition amount of styrene was decreased by 10 weight % (the first addition amount was 103.5 g and the latter addition amount was 345.2 g), the addition amount of n-butylacrylate was increased by 10 weight % (the first addition amount was 46.2 g and the latter addition amount was 154.0 g) and the addition amount of methacrylic acid was decreased by 10 weight % (the first addition amount was 9.8 g and the latter addition amount was 32.8 g).

(Preparation of Resin Particles (A3) Dispersion)

"Resin particle (A3) dispersion" was prepared in a similar manner to preparation of the "resin particle (A1) dispersion", except that the addition amount of styrene was increased by 10 weight % (the first addition amount was 126.6 g and the latter addition amount was 422.0 g), the addition amount of n-butylacrylate was decreased by 10 weight % (the first addition amount was 37.8 g and the latter addition amount was 126.0 g) and the addition amount of methacrylic acid was increased by 10 weight % (the first addition amount was 12.0 g and the latter addition amount was 40.0 g).

(Preparation of Resin Particles (A4) Dispersion)

"Resin particle (A4) dispersion" was prepared in a similar manner to preparation of the "resin particle (A1) dispersion", except that example compound (20) was not added.

The types and ratios of polymerizing monomers, and releasing agents, which were utilized to form "resin particles (A1)-(A4)", and the molecular weight are shown in table 1.

TABLE 1

| Resin particles (A) | Type and ratio (weight %) of polymerizing monomer | | | Releasing agent | Molecular weight |
|---|---|---|---|---|---|
| 1 | Styrene (69) | n-butyl acrylate (25) | Methacrylic acid (6) | Example compound (20) | 29,000 |
| 2 | Styrene (65) | n-butyl acrylate (29) | Methacrylic acid (6) | Example compound (20) | 25,000 |
| 3 | Styrene (72) | n-butyl acrylate (21) | Methacrylic acid (7) | Example compound (20) | 35,000 |
| 4 | Styrene (69) | n-butyl acrylate (25) | Methacrylic acid (6) | — | 29,000 |

(Preparation of Resin Particles (B1) Dispersion)

A surfactant solution, in which 7.08 g of an anionic surfactant has been dissolved in 2760 g of ion exchanged water, was charged into a separable flask equipped with a stirrer, a thermometer, a condenser and a nitrogen introducing device, and the inside temperature was raised up to 80° C. while being stirred at 230 rpm under nitrogen gas flow.

| | |
|---|---|
| On the other hand, | |
| Styrene | 125.0 g |
| 2-ethylhexyl acrylate | 75.0 g |
| Maleic acid | 50.0 g |

were mixed and dissolved at 80° C. to prepare a monomer solution. The above-described two heated solutions were mixed and dispersed, by use of a mechanical homogenizer having a circulating path, resulting in preparation of emulsion particles having a uniform dispersion particle diameter. Next, a solution, in which 0.84 g of a polymerization initiator (potassium persulfate:KPS) was dissolved in 200 g of ion exchanged water, was added to the system, which was heated and stirred for 3 hours resulting in preparation of resin particles. This resin particle dispersion was designated as "resin particle (B1) dispersion".

(Preparation of Resin Particle (B2) Dispersion)

"Resin particle (B2) dispersion" was prepared in a similar manner to preparation of "resin particle (B1) dispersion", except that the amount of styrene was changed from 125.0 g to 87.5 g, the amount of 2-ethylhexyl acrylate from 75.0 g to 125.0 g and the amount of maleic acid from 50.0 g to 37.5 g.

(Preparation of Rein Particle (B3) Dispersion)

"Resin particle (B3) dispersion" was prepared in a similar manner to preparation of "resin particle (B1) dispersion", except that maleic acid was changed to itaconic acid.

(Preparation of Rein Particle (B4) Dispersion)

"Resin particle (B4) dispersion" was prepared in a similar manner to preparation of "resin particle (B1) dispersion", except that amount of styrene is changed to 87.5 g, 75.0 g of 2-ethylhexyl acrylate was changed to 125.0 g of 2-ethylhexyl methacrylate and 50 g of maleic acid was changed to 37.5 g of itaconic acid.

(Preparation of Rein Particle (B5) Dispersion)

"Resin particle (B5) dispersion" was prepared in a similar manner to preparation of "resin particle (B1) dispersion", except that amount of styrene is changed to 162.5 g, and 50 g of maleic acid was changed to 12.5 g of itaconic acid.

(Preparation of Rein Particle (B6) Dispersion)

"Resin particle (B6) dispersion" was prepared in a similar manner to preparation of "resin particle (B1) dispersion", except that 2-ethylhexyl acrylate was changed to 2-ethylhexyl methacrylate.

(Preparation of Rein Particle (B7) Dispersion)

"Resin particle (B7) dispersion" was prepared in a similar manner to preparation of "resin particle (B1) dispersion", except that amount of styrene is changed to 162.5 g, 75.0 g of 2-ethylhexyl acrylate is changed to 62.5 g of 2-ethylhexyl methacrylate and 50 g of maleic acid is changed to 25.0g of itaconic acid.

(Preparation of Rein Particle (B8) Dispersion)

"Resin particle (B8) dispersion" was prepared in a similar manner to preparation of "resin particle (B1) dispersion", except that amount of styrene is changed to 50 g, 75.0 g of 2-ethylhexyl acrylate is changed to 112.5 g of 2-ethylhexyl methacrylate and 50 g of maleic acid is changed to 87.5 g of itaconic acid.

(Preparation of Rein Particle (B9) Dispersion)

"Resin particle (B9) dispersion" was prepared in a similar manner to preparation of "resin particle (B1) dispersion", except that the styrene and maleic acid were not utilized and were replaced by same amount of 2-ethylhexyl acrylate.

(Preparation of Rein Particle (B10) Dispersion)

"Resin particle (B10) dispersion" was prepared in a similar manner to preparation of "resin particle (B1) dispersion", except that the 2-ethylhexyl acrylate and maleic acid were not utilized and were replaced by same amount of styrene.

Types and ratios of polymerizing monomers utilized to form "resin particles (B1)-(B10)" and the molecular weight are shown in table 2.

TABLE 2

| Resin particles (B) | Type and ratio (weight %) of polymerizing monomer | | | Molecular weight |
|---|---|---|---|---|
| 1 | Styrene (50) | 2-ethylhexyl acrylate (30) | Maleic acid (20) | 24,000 |
| 2 | Styrene (35) | 2-ethylhexyl acrylate (50) | Maleic acid (15) | 20,000 |
| 3 | Styrene (50) | 2-ethylhexyl acrylate (30) | Itaconic acid (20) | 23,000 |
| 4 | Styrene (35) | 2-ethylhexyl methacrylate (50) | Itaconic acid (15) | 20,000 |
| 5 | Styrene (65) | 2-ethylhexyl acrylate (30) | Itaconic acid (5) | 25,000 |
| 6 | Styrene (50) | 2-ethylhexyl methacrylate (30) | Maleic acid (20) | 24,000 |
| 7 | Styrene (65) | 2-ethylhexyl methacrylate (25) | Itaconic acid (10) | 25,000 |
| 8 | Styrene (20) | 2-ethylhexyl methacrylate (45) | Itaconic acid (35) | 15,000 |

TABLE 2-continued

| Resin particles (B) | Type and ratio (weight %) of polymerizing monomer | | | Molecular weight |
|---|---|---|---|---|
| 9 | — | 2-ethylhexyl acrylate (100) | — | 13,000 |
| 10 | Styrene (100) | — | — | 28,000 |

(Preparation of Colorant Dispersion 1)

Sodium n-dodecyl sulfate of 9.2 g was dissolved with stirring in 160 g of ion exchanged water. Carbon black "REGAL 330R" (manufactured by Cabbot Corp.) of 20 g was gradually added into this solution while being stirred, and the resulting solution was homogenized by use of CLEARMIX to prepare a dispersion. The particle diameter of a colorant in the above-described dispersion was measured by use of an electrophoresis light-scattering photometer "ELS-800" (manufactured by Otsuka Electronics Co., Ltd.) to be 112 nm as a weight average particle diameter. This dispersion is designated as "colorant dispersion 1".

(Preparation of Releasing Agent Dispersion 1)

A surfactant solution, in which 7.08 g of an anionic surfactant (sodium dodecylbenzene sulfonate:SDS) had been dissolved in 276 g of ion exchanged water in advance, was charged into a 500 ml separable flask equipped with a stirrer, a thermometer, a condenser and a nitrogen introducing device, and 7.2 g of example compound (20) were added with stirring at 230 rpm under a nitrogen gas flow to be mixing dispersed, resulting in preparation of a dispersion. The particle diameter of a releasing agent in the above-described dispersion was measured by use of an electrophoresis light-scattering photometer "ELS-800" (manufactured by Otsuka Electronics Co., Ltd.) to be 100 nm as a weight average particle diameter. This dispersion is designated as "releasing agent dispersion 1".

(Preparation of Toner Particles 1)

The aforesaid "resin particle dispersion (A1)"of 1250 g, 125 g of "resin particle dispersion (B1)", 2000 g of ion-exchanged water and "colorant dispersion 1" were charged in a four-necked flask equipped with a thermometer, a condenser, a nitrogen introducing device and a stirrer, and subjected to stirring. After the temperature of the resulting solution was adjusted at 30 °C., a 5 mol/L aqueous solution of sodium hydroxide was added to this solution to adjust the pH to 10.0 . Successively, an aqueous solution, in which 52.6 g of magnesium chloride were dissolved in 72 g of ion exchanged water, was added in 10 minutes under stirring. Then, after the solution was kept standing for 3 minutes, the temperature was raised to reach 90 °C. in 6 minutes (temperature rising rate =10 °C./min). The particle growth was stopped by addition of an aqueous solution, in which 115 g of sodium chloride were dissolved in 700 g of ion exchanged water, when the median particle diameter (D50) in volume distribution, which was measured by "COULTER COUNTER TA-II"(manufactured by Coulter Inc.) in the above state, reached 6.5 μm, followed by being heated and stirred for 6 hours at a solution temperature of 90 °C..+-.2 °C. to perform salting out/fusion. Then, the resulting product was cooled down to 30 °C. under a condition of 20 C./min, and hydrochloric acid was added to adjust the pH to 2.0 to stop stirring.

Produced toner particles were subjected to solid-liquid separation and to washing with ion-exchanged water 4 times (the amount of ion exchanged water was 15 L), followed by being dried to obtain toner particles. This is designated as "toner particle 1".

(Preparation of Toner Particles 2-11 and 13-17)

"Toner particles 2-11 and 13-17" were prepared in a similar manner to preparation of "toner particle 1", except that "resin particle (A1) dispersion" and "resin particle (B1) dispersion" were changed to those described in table 3.

(Preparation of Toner Particles 12)

"Toner particles 12" were prepared in a similar manner to preparation of "toner particle 1", except that 1000 g of "resin particles (A4) dispersion", 120 g of "resin particles (B1) dispersion", 2000 g of ion exchanged water and "colorant dispersion 1" were charged in a four necked flask similar to that utilized in preparation of "toner particle 1".

In this manner, "toner particles 12" are prepared by performing aggregation incorporating a colorant and a releasing agent in the presence of resin particles.

In table 3, shown are the ratio of resin particles (A) which constitute resin phase A and resin particles (B) which constitute resin phase B, the peak molecular weight, the ratio of resin particles having a molecular weight of not more than 5000, the size of resin phase B, the glass transition temperature and a SP value.

Herein, the peak molecular weight and the ratio of resin having a molecular weight of not more than 5000 were determined by means of the aforesaid gel permeation chromatography (GPC); the glass transition temperature was determined by means of a differential thermal analyzer (DSC); and the solubility parameter value was calculated by the aforesaid equation (3).

Further, resin phase B was confirmed based on observation through the aforesaid transparent type electron microscope (TEM) "S-5000H" (manufactured by Hitachi).

As shown in table 3, "toner particles 1-12 and 15"according to this invention have been confirmed to be provided with a structure in which resin phase B is included in the toner particles, however, "toner particles 14, 16 and 17", which are comparative examples, are not confirmed to be provided with resin phase B in the toner particles.

Herein, with respect to dried "toner particles 1 - 17 ", the amount of metal elements remained on the toner surface was measured by use of the aforesaid fluorescent X ray analyzer "SYSTEM 3270 Type"(manufactured by Rigaku Electric Industry Co., Ltd.) to be 800 - 5,000 ppm.

(External Additive Treatment of Toner)

Next, 1 weight % of hydrophobic silica(number average primary particle diameter of 12 nm and hydrophobicity of 68) and 1 weight % of hydrophobic titanium oxide(number average primary particle diameter of 20 nm and hydrophobicity of 63) in each of "toner particles 1-17", and being mixed by use of a "HENSCHEL MIXER" (manufactured by Mitsui-Miike Chemical Industry Co., Ltd.). Thereafter, coarse particles were eliminated by use of a sieve having a 45 μm mesh, resulting in preparation of "toner 1-17".

<Preparation of Developer>

Ferrite carrier, which is covered with silicone resin and has a median diameter (D50) in volume distribution of 60 μm, was mixed into each "toner 1-17" prepared above so as to make 6 weight % of the aforesaid toner concentration, resulting in preparation of "developers 1-17".

<Evaluation>

With respect to toner prepared above, evaluations of the following items were performed. Herein, the examples using developers 1 to 12 and 15 (toner 1 to 12 and 15) correspond to Examples 1 to 13 respectively, and the examples using developers 13, 14, 16 and 17 (toners 13, 14, 16 and 17) correspond to Comparative examples 1 to 4.

As an evaluation machine, a copying machine "SITIOS 7165" (manufactured by Konicaminolta Business Technology Inc.), which employs an electrophotographic method and is available on the market, was utilized.

<Storage Stability (Tropical Heat Storage Stability) of Toner>

After 100 g of each toner were kept under a condition of 55° C. and 90% RH for 24 hours, followed by being sieved

TABLE 3

| Toner No. | Resin composition ratio Resin A Wt % | Resin B Wt % | Peak Molecular weight | Ratio of Molecular weight of not more than 5000 (wt %) | Glass Transition temperature Resin A (° C.) | Resin B (° C.) | Diameter of resin phase B (nm) | SP value Resin (A) | Resin (B) |
|---|---|---|---|---|---|---|---|---|---|
| 1 | A1(97) | B2(3) | 20000, 29000 | 17 | 67 | 36 | 50-180 | 10.2 | 9.8 |
| 2 | A1(95) | B4(5) | 20000, 29000 | 15 | 67 | 38 | 60-220 | 10.2 | 9.8 |
| 3 | A1(90) | B2(10) | 20000, 29000 | 12 | 67 | 36 | 70-580 | 10.2 | 9.8 |
| 4 | A1(85) | B4(15) | 20000, 29000 | 14 | 67 | 38 | 90-600 | 10.2 | 9.8 |
| 5 | A1(80) | B2(20) | 20000, 29000 | 13 | 67 | 36 | 90-600 | 10.2 | 9.8 |
| 6 | A1(90) | B1(10) | 24000, 29000 | 18 | 67 | 40 | 100-500 | 10.2 | 9.8 |
| 7 | A1(90) | B3(10) | 23000, 29000 | 15 | 67 | 48 | 100-600 | 10.2 | 9.7 |
| 8 | A1(80) | B5(20) | 25000, 29000 | 17 | 67 | 30 | 60-580 | 10.2 | 9.5 |
| 9 | A1(90) | B6(10) | 24000, 29000 | 18 | 67 | 50 | 80-550 | 10.2 | 9.9 |
| 10 | A3(90) | B7(10) | 25000, 35000 | 20 | 73 | 35 | 50-480 | 10.5 | 10.0 |
| 11 | A2(85) | B8(15) | 15000, 25000 | 20 | 64 | 15 | 80-450 | 10.9 | 9.7 |
| 12 | A4(85) | B4(15) | 20000, 29000 | 16 | 68 | 38 | 200-600 | 10.3 | 9.8 |
| 13 | A2(85) | B9(15) | 13000, 25000 | 27 | 64 | 5 | 630-750 | 10.9 | 9.0 |
| 14 | A1(90) | B10(10) | 28000, 29000 | 24 | 67 | 67 | — | 10.2 | 10.2 |
| 15 | A1(70) | B1(30) | 24000, 29000 | 19 | 67 | 40 | 50-400 | 10.2 | 9.8 |
| 16 | A1(100) | — | 29000 | 27 | 67 | — | — | 10.2 | — |
| 17 | — | B6(100) | 24000 | 30 | — | 50 | — | — | 9.9 |

through a sieve provided with a 45 μm mesh, and toner keeping stability was evaluated based on the amount (a ratio) of a aggregated substance on the sieve.

Evaluation Criteria

A: The amount on a sieve is less than 5% and aggregation is minimum, which is excellent (No aggregation is generated even when toner is transported in summer time employing no adiabatic packaging materials at all).

B: The amount on a sieve is less than 5-30% and the amount of aggregation is small, which is good (No aggregation is generated even when toner is transported in summer time only with corrugated cardboard packaging).

C: The amount on a sieve is not less than 30% and the amount of aggregation is significant, which is problematic in practical use (Cooled transportation is required).

<Evaluation of Fixing Ability>

The surface temperature of a heat roller of a fixing device in the above-described evaluation machine was changed so as to vary the paper temperature at 10° C. intervals in a range of 80-150° C., and a toner image was fixed at each varied temperature to prepare a fixed image. Herein, plain paper of an A4 size was utilized for print image preparation.

The fixing strength was evaluated by a fixing ratio by use of a method corresponding to a mending tape peeling method which is described in chapter 9, items 1 and 4, "Fundamentals and Applications of Electrophotographic Technology: edited by Electrophotographic Society of Japan".

Specifically, after preparing a black solid print image of a 2.54 cm square having a toner amount of 0.6 mg/cm $^2$, the image densities before and after peeling with "SCOTCH MENDING TAPE"(manufactured by Sumitomo 3 M Corp.) were measured to determine a residual ratio of the image density as a fixing ratio.

The fixing temperature to obtain a fixing ratio of not less than 95% is designated as a fixable temperature. Herein, a reflection densitometer "RD-918" (manufactured by Macbeth Co., Ltd.) was utilized to measure the image density.

Evaluation Criteria

A: Fixing is possible at a paper temperature of not higher 90° C.

B: Fixing is possible at a paper temperature of not higher 120° C.

C: Fixing is impossible at a paper temperature of not higher 120° C.

<Fixing Ability on Most Heavy Paper>

Continuous print was performed on 500 sheets of Most Heavy Post Card (0.4 mm thick) manufactured by Heart Co., Ltd. by use of an image forming apparatus described in FIG. 2. The obtained print was ranked according to the following criteria.

Evaluation Criteria

A: Toner is not peeled off at all when a letter is strongly written with a dipping pen on the 500th print image.

B: Toner is peeled off when a letter is strongly written with a dipping pen on the 500th print image, however, no peeling off of toner is caused when a letter is strongly written with a ball-point pen on the 500th print image.

C: Toner is peeled off and the hand becomes dirty only with a hand touch on the 500th print image.

<Fixing Ability on Coated Paper>

Letter print of 250 sheets of Coated Paper (60 g/m$^2$) manufactured by Daio Paper Mills, Ltd., and bleeding dirt around a letter was observed visually and by a loupe (magnification of 10 times) after the printed sheet has been turned over 10 times with the thumb. Ranking evaluation was performed according to the following criteria.

Evaluation Criteria

A: No bleeding dirt is generated at all.

B: No bleeding dirt is visually observed and only slight dirt is recognized by loupe observation, which is not problematic in practical use.

C: Black bleeding dirt was observed at the trace of the thumb.

<Off Set Resistance>

A line image of 0.3 mm width and 150 mm length being parallel to the paper transport direction was formed by use of heavy paper of high quality paper (200 g/m$^2$) as a recording sheet, and evaluated were dirt on white paper due to off set and dirt on the surface of a heat roller.

Evaluation Criteria

A: Neither of dirt on white paper due to off set nor dirt on the surface of a heat roller is observed at all, which is excellent.

B: No dirt on white paper due to off set is recognized, however, some dirt on the surface of a heat roller is observed, which is good.

C: Dirt on white paper due to off set is recognized, which is problematic in practical use.

<Glossiness>

With respect to a printed out solid image on art paper (Tokuryo Art, manufactured by Mitsubishi Paper Mills, Ltd.) as a recording sheet, the glossiness was measured by use of a gloss meter (at an incident angle of 75±0.10) available on the market.

Evaluation Criteria

A: A glossiness of not less than 40% is provided, which is excellent.

B: A glossiness of 20-40% is provided which is good.

C: A glossiness of less than 20 is provided, which is inferior in practical application.

<Gloss Unevenness>

A printed out solid image on art paper (Tokuryo Art, manufactured by Mitsubishi Paper Mills Ltd.) as a recording sheet is observed visually or by a loupe to perform the evaluation.

Evaluation Criteria

A: No gloss unevenness is observed at all.

B: No gloss unevenness is observed unless it is magnified by a loupe.

C: Streak gloss unevenness can be visually observed.

The evaluation results are shown in table 4.

TABLE 4

| | Toner No. | Storage stability of toner | Fixing ability | Fixing ability on most heavy paper | Fixing ability on coated paper | Off set resistance | Glossiness | Gloss unevenness |
|---|---|---|---|---|---|---|---|---|
| Ex. 1 | 1 | A | A | A | A | A | B | B |
| Ex. 2 | 2 | A | A | A | A | A | B | A |
| Ex. 3 | 3 | A | A | A | A | A | A | A |
| Ex. 4 | 4 | A | A | A | A | A | A | A |

TABLE 4-continued

| | Toner No. | Storage stability of toner | Fixing ability | Fixing ability on most heavy paper | Fixing ability on coated paper | Off set resistance | Glossiness | Gloss unevenness |
|---|---|---|---|---|---|---|---|---|
| Ex. 5 | 5 | A | A | A | A | A | B | B |
| Ex. 6 | 6 | A | A | A | A | A | B | A |
| Ex. 7 | 7 | A | A | A | A | A | A | A |
| Ex. 8 | 8 | B | A | A | A | A | B | A |
| Ex. 9 | 9 | A | A | A | A | A | A | B |
| Ex. 10 | 10 | B | A | A | A | B | A | B |
| Ex. 11 | 11 | B | A | A | A | A | A | A |
| Ex. 12 | 12 | A | A | A | A | B | A | A |
| Ex. 13 | 15 | B | B | B | B | B | B | B |
| Com. 1 | 13 | C | C | C | C | B | C | C |
| Com. 2 | 14 | C | C | B | B | C | C | B |
| Com. 4 | 16 | B | C | C | C | C | C | C |
| Com. 5 | 17 | C | C | C | C | C | C | C |

It is clear from table 4 that any of Examples 1-13" is excellent in every evaluation items, however, "comparisons 1-4" have a problem at least in any one of the evaluation items.

And, with respect to these toner, evaluation experiments similar to those described above were performed to confirm that there is a tendency of the storage stability and odor at the time of printing, with respect to the toner having been subjected twice washing, being somewhat inferior the toner having been subjected 4 times washing, however, every evaluation results came up to the standard. Further, it has been confirmed that toner particles with 6 times washing showed a tendency of fixing ability on coated paper being somewhat inferior to those with 4 times washing, however, achieved results similar to those with 4 times washing with respect to other evaluation items.

What is claimed is:

1. Toner for developing an electrophotographic latent image comprising a binder resin, wherein the binder resin comprises at least a first and second copolymers formed by at least vinyl polymerizing monomer, the first copolymer is formed by at least a monomer having at least two polar groups, and the binder resin comprises peaks of molecular weight in ranges of from 15000 to 25000 and from 25000 to 35000, respectively.

2. The toner of claim 1, wherein the monomer having at least two polar groups comprises a dicarboxylic acid monomer as a copolymer component.

3. The toner of claim 1, wherein the polar group comprises a carboxyl group, sulfone group, amino group, or ammonium group.

4. The toner of claim 1, wherein the monomer having at least two polar groups is itaconic acid or maleic acid.

5. The toner of claim 1, wherein the binder comprises a first phase having a glass transition point of 50°C. or less and a second phase having a glass transition point of 70°C. or less.

6. The toner of claim 5, wherein the first phase has a solubility parameter value of 9.5 to 10.0, and the second phase has a solubility parameter value of 10.0 to 10.5.

7. The toner of claim 1, wherein the binder resin comprises peaks of molecular weight in ranges from 20,000 to 25,000 and from 25,000to 30,000, respectively.

8. The toner of claim 1, wherein the toner contains 250 -20,000 ppm of a polyvalent metal element.

9. A method for manufacturing toner of claim 1, which method comprising:

aggregating particles of the first copolymer, and aggregating at least particles of the second copolymer after aggregating the particles of the first copolymer.

10. The method of claim 9, wherein the first copolymer is formed by utilizing a monomer having at least two carboxyl groups.

11. An image forming method comprising:

forming an electrostatic latent image on a photoreceptor, and developing the latent image with the toner as defined in claim 1.

12. The method of claim 11, wherein the first copolymer is formed by utilizing a monomer having at least two carboxyl groups.

* * * * *